United States Patent [19]

Kato et al.

[11] Patent Number: 4,960,661

[45] Date of Patent: Oct. 2, 1990

[54] ELECTROPHOTOGRAPHIC LITHOGRAPHIC PRINTING PLATE PRECURSOR

[75] Inventors: Eiichi Kato; Kazuo Ishii, both of Shizuoka, Japan

[73] Assignee: Fuji Photo Film Co., Ltd., Kanagawa, Japan

[21] Appl. No.: 303,220

[22] Filed: Jan. 30, 1989

[30] Foreign Application Priority Data

Jan. 28, 1988 [JP] Japan ..... 63-15847
Feb. 2, 1988 [JP] Japan ..... 63-21354

[51] Int. Cl.[5] ..... G03G 5/087

[52] U.S. Cl. ..... 430/49; 430/87; 430/96

[58] Field of Search ..... 430/49, 87, 96

[56] References Cited

U.S. PATENT DOCUMENTS 4,792,511 12/1988 Kato et al. ..... 430/87
4,828,952 5/1989 Kato et al. ..... 430/87

*Primary Examiner*—John L. Goodrow
*Attorney, Agent, or Firm*—Sughrue, Mion, Zinn, Macpeak & Seas

[57] ABSTRACT

An electrophotographic lithographic printing plate precursor comprising a conductive support having provided thereon at least one photoconductive layer containing photoconductive zinc oxide and a resin binder, wherein said resin binder comprises (A) at least one resin containing at least one functional group capable of forming at least one carboxyl group upon decomposition and at least one of (B) a heat-curable or a photocurable resin, and (C) a cross-linking agent. The plate precursor provides a printing plate having excellent resistance to background stains and printing durability.

13 Claims, No Drawings

ELECTROPHOTOGRAPHIC LITHOGRAPHIC PRINTING PLATE PRECURSOR

FIELD OF THE INVENTION

This invention relates to an electrophotographic lithographic printing plate precursor, and, more particularly, to an improved resin binder forming a photoconductive layer of a lithographic printing plate precursor.

BACKGROUND OF THE INVENTION

A number of offset printing plate precursors for directly producing printing plates have hitherto been proposed and put into practical use. Widely employed among them is a system in which a photoreceptor comprising a conductive support having provided thereon a photoconductive layer mainly comprising photoconductive particles, e.g., zinc oxide, and a resin binder is subjected to an ordinary electrophotographic processing to form a highly lipophilic toner image thereon and the surface of the photoreceptor is then treated with an oil-desensitizing solution, often referred to as an etching solution, to selectively render non-image areas hydrophilic, to thereby obtain an offset printing plate.

Requirements of offset printing plate precursors for obtaining satisfactory prints are such that: an original should be reproduced faithfully on the photoreceptor; the surface of a photoreceptor has affinity with an oil-desensitizing solution so as to render non-image areas sufficiently hydrophilic, while, at the same time, having water resistance; and that a photoconductive layer having an image formed thereon is not released during printing and is well receptive to dampening water so that the non-image areas hold the hydrophilic properties enough to be free from stains even on printing a large number of prints.

It is known that these performance properties of the printing plate precursors are influenced by the ratio of zinc oxide to resin binder in the photoconductive layer. For example, as the ratio of resin binder to zinc oxide particles becomes small, oil-desensitization of the surface of the photoconductive layer is increased, to reduce background stains, but, in turn, the internal cohesion of the photoconductive layer per se is weakened, resulting in reduction of printing durability due to insufficient mechanical strength. On the other hand, as the proportion of the resin binder increases, printing durability is improved, but background staining tends to become conspicuous. With respect to background staining, while it is a phenomenon associated with the degree of oil-desensitization achieved, it has been elucidated that the oil-desensitization of the photoconductive layer surface depends not only on the zinc oxide/resin binder ratio in the photoconductive layer, but also greatly on the kind of the resin binder used.

Resin binders which have been conventionally known include silicon resins (see JP-B-34-6670, the term "JP-B" as used herein means an "examined published Japanese Patent application"), styrene-butadiene resins (see JP-B-35-1950), alkyd resins, maleic acid resins, polyamides (see JP-B-35-11219), vinyl acetate resins (see JP-B-41-2425), vinyl acetate copolymer resins (see JP-B-41-2426), acrylic resins (see JP-B-35-11216), acrylic ester copolymer resins (see JP-B-35-11219, 36-8510, and 41-13946), etc. However, electrophotographic light-sensitive materials using these known resins suffer from several disadvantages, such as (1) low charging characteristics of the photoconductive layer; (2) poor quality of a reproduced image, particularly dot reproducibility or resolving power; (3) low sensitivity to exposure; (4) insufficient oil-desensitization attained by oil-desensitization for use as an offset master, which results in background stains on prints when used for offset printing; (5) insufficient film strength of the light-sensitive layer, which causes release of the light-sensitive layer during offset printing, failing to obtain a large number of prints; (6) susceptibility of image quality to influences of environment at the time of electrophotographic image formation, such as high temperatures and high humidities; and the like.

For the particular use as an offset printing plate precursor, formation of background stains due to insufficient oil-desensitization presents a serious problem. In order to solve this problem, various resins have been proposed as binders for zinc oxide which would improve oil-desensitization, including a resin having a molecular weight of from $1.8\times10^4$ to $1\times10^5$ and a glass transition point of from 10 to 80° C. which is obtained by copolymerizing a (meth)acrylate monomer and a copolymerizable monomer in the presence of fumaric acid as disclosed in JP-B-50-31011; a terpolymer containing a (meth)acrylic ester unit having a substituent having a carboxylic group at least 7 atoms distant from the ester linkage as disclosed in JP-A-53-54027 (the term "JP-A" as used herein means an "unexamined published Japanese patent application); a tetra- or pentamer containing an acrylic acid unit and a hydroxyethyl (meth)acrylate unit as disclosed in JP-A-54-20735 and 57-202544; a terpolymer containing a (meth)acrylic ester unit having an alkyl group having from 6 to 12 carbon atoms as a substituent and a vinyl monomer containing a carboxylic acid group as disclosed in JP-A-58-68046; and the like.

Nevertheless, evaluations of these resins proposed for improving oil-desensitization revealed that none of them is fully satisfactory in terms of stain resistance and printing durability.

The use of resins having a functional group capable of forming a hydrophilic group on decomposition as a binder has been studied. For example, there have been proposed resins having a functional group capable of forming a hydroxyl group on decomposition, as disclosed in JP-A-62-195684, 62-210475, and 62-210476, and resins having a functional group capable of forming a carboxyl group on decomposition, as disclosed in JP-A-62-21269.

These functional group-containing resins form a hydrophilic group upon being hydrolyzed or hydrogenolyzed with an oil-desensitizing solution or dampening water used during printing. It has been reported that use of these resins as a binder of a lithographic printing plate precursor can avoid various problems associated with use of resins containing a hydrophilic group from the first, such as deterioration of surface smoothness and electrophotographic characteristics, which seem ascribable to the strong interaction between the hydrophilic group and the surface of the photoconductive zinc oxide particles. It has also been expected that the hydrophilic properties of the non-image areas attained by an oil-desensitizing solution can be enhanced by the hydrophilic group formed by decomposition of the resin, so that a clear distinction can be made between the lipophilic image area and the hydrophilic non-image area. Adhesion of a printing ink onto the non-image areas during printing can thus be prevented, thereby making it possible to obtain a large number of prints having a clear image free from background stains.

However, the above-described functional group-containing resins capable of forming a hydrophilic group are still unsatisfactory in resistance to background stain and printing durability. In particular, it has turned out that the resin becomes water-soluble as its amount is increased for further improving hydrophilic properties of the non-image areas, thus impairing durability of the hydrophilic properties. Hence, there is a demand to develop a technique by which the hydrophilic properties of the non-image areas can be assured, while still lasting long. Namely, it has been keenly desired to establish a technique in which the effect to improve hydrophilic properties can be retained or enhanced even if the proportion of the resin containing a hydrophilic group-forming functional group in the total resin binder is decreased, or a large number of clear prints can be obtained without suffering from background stains even if the printing conditions are made more strict due to an increase of a printing machine in size or a variation of printing pressure.

SUMMARY OF THE INVENTION

One object of this invention is to provide a lithographic printing plate precursor which reproduces an image faithful to an original, exhibits satisfactory hydrophilic properties on the non-image areas thereby forming no background stains, satisfactory surface smoothness and electrophotographic characteristics, and excellent printing durability.

Another object of this invention is to provide a lithographic printing plate precursor which is not influenced by a variation of environmental conditions of electrophotographic processing and exhibits excellent preservability before processing.

It has now been found that the above objects can be accomplished by an electrophotographic lithographic printing plate precursor comprising a conductive support having provided thereon at least one photoconductive layer containing photoconductive zinc oxide and a resin binder, wherein said resin binder comprises (A) at least one resin containing at least one functional group capable of forming at least one carboxyl group upon decomposition on at least one of (B) a heat-curable and a photo-curable resin and (C) a cross-linking agent.

The feature of the present invention lies in the use of the resin (A) containing a functional group capable of forming a carboxyl group on decomposition in combination with at least one of (B) the heat-curable or photo-curable resin and (C) cross-linking agent which forms a cross-linked structure between polymer components.

DETAILED DESCRIPTION OF THE INVENTION

The resin which can be used in the present invention as a binder contains (A) at least one resin containing at least one functional group capable of forming one or more carboxyl groups upon decomposition (hereinafter sometimes referred to as carboxyl-forming functional group-containing resin) and at least one of (B) a heat-curable or photo-curable resin and (C) a cross-linking agent.

In a preferred embodiment of the invention, the carboxyl-forming functional group contained in the resin (A) is represented by formula (I)

$$-COO-L_1 \qquad (I)$$

wherein $L_1$ represents

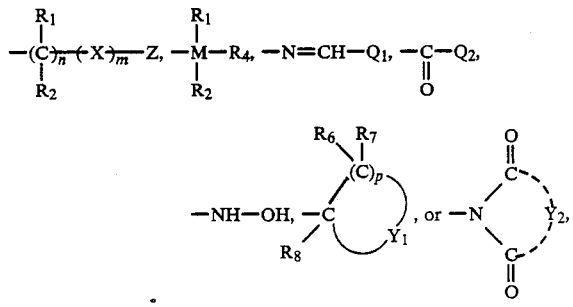

wherein $R_1$ and $R_2$ (which may be the same or different) each represents a hydrogen atom or an aliphatic hydrocarbon group; X represents an aromatic hydrocarbon group; Z represents a hydrogen atom, a halogen atom, a trihalomethyl group, an alkyl group, —CN, $—NO_2$, $—SO_2R_1'$, wherein $R_1'$ represents a hydrocarbon group, $—COOR_2'$, wherein $R_2'$ represents a hydrocarbon group, or $—O—R_3'$, wherein $R_3'$ represents a hydrocarbon group; n and m each represents 0, 1, or 2; $R_3$, $R_4$, and $R_5$ (which may be the same or different) each represents a hydrocarbon group or $—O—R_4'$, wherein $R_4'$ represents a hydrocarbon group; M represents Si, Sn, or Ti; $Q_1$ and $Q_2$ each represents a hydrocarbon group; $Y_1$ represents an oxygen atom or a sulfur atom; $R_6$, $R_7$, and $R_8$ (which may be the same or different) each represents a hydrogen atom or an aliphatic hydrocarbon group; p represents 3 or 4; and $Y_2$ represents an organic residual group forming a cyclic imido group.

In formula (I) wherein $L_1$ is

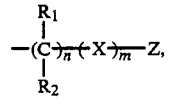

$R_1$ and $R_2$ each preferably represents a hydrogen atom or a substituted or unsubstituted straight chain or branched alkyl group having from 1 to 12 carbon atoms (e.g., methyl, ethyl, propyl, chloromethyl, dichloromethyl, trichloromethyl, trifluoromethyl, butyl, hexyl, octyl, decyl, hydroxyethyl, 3-chloropropyl); X preferably represents a substituted or unsubstituted phenyl or naphthyl group (e.g., phenyl, methylphenyl, chlorophenyl, dimethylphenyl, chloromethylphenyl, naphthyl); Z preferably represents a hydrogen atom, a halogen atom (e.g., chlorine, fluorine), a trihalomethyl group (e.g., trichloromethyl, trifluoromethyl), a substituted or unsubstituted straight chain or branched alkyl group having from 1 to 12 carbon atoms (e.g., methyl, chloromethyl, dichloromethyl, ethyl, propyl, butyl, hexyl, tetrafluoroethyl, octyl, cyanoethyl, chloroethyl), —CN, $—NO_2$, $—SO_2R_1'$ [$R_1'$ represents an aliphatic group including a substituted or unsubstituted alkyl group having from 1 to 12 carbon atoms (e.g., methyl, ethyl, propyl, butyl, chloroethyl, pentyl, octyl) and a substituted or unsubstituted aralkyl group having from 7 to 12 carbon atoms (e.g., benzyl, phenethyl, chlorobenzyl, methoxybenzyl, chlorophenethyl, methylphenethyl), or an aromatic group including a substituted or unsubstituted phenyl or naphthyl group (e.g., phenyl, chlorophenyl, dichlorophenyl, methylphenyl, methoxyphenyl, acetylphenyl, acetamidophenyl, methoxycarbonylphenyl, naphthyl)], $—COOR_2'$ ($R_2'$ has the same meaning as $R_1'$ as described above), or —O—$R_3'$ ($R_3'$ has the same meaning as $R_1'$ as described above); and n and m each represents 0, 1, or 2.

Specific examples of $L_1$ as represented by

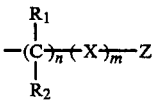

include a β,β,β-trichloroethyl group, a β,β,β-trifluoroethyl group, a hexafluoroisopropyl group, a group of formula —$CH_2CF_2CF_2)_nH$ wherein n' represents an integer of from 1 to 5, a 2-cyanoethyl group, a 2-nitroethyl group, a 2-methanesulfonylethyl group, a 2-ethanesulfonylethyl group, a 2-butanesulfonylethyl group, a benzenesulfonylethyl group, a 4-nitrobenzenesulfonylethyl group, a 4-cyanobenzenesulfonylethyl group, a 4-methylbenzenesulfonylethyl group, a substituted or unsubstituted benzyl group (e.g., benzyl, methoxybenzyl, trimethylbenzyl, pentamethylbenzyl, nitrobenzyl), a substituted or unsubstituted phenacyl group (e.g., phenacyl, bromophenacyl), and a substituted or unsubstituted phenyl group (e.g., phenyl, nitrophenyl, cyanophenyl, methanesulfonylphenyl, trifluoromethylphenyl, dinitrophenyl).

In formula (I) wherein $L_1$ is

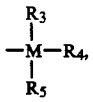

$R_3$, $R_4$, and $R_5$ (which may be the same or different) each preferably represents a substituted or unsubstituted aliphatic group having from 1 to 18 carbon atoms including an alkyl group, an alkenyl group, an aralkyl group, and an alicyclic group, each of which may have a substituent (e.g., a halogen atom, —CN, —OH, —O—Q', wherein Q' represents an alkyl group, an aralkyl group, an alicyclic group, or an aryl group), or a substituted or unsubstituted aromatic group having from 6 to 18 carbon atoms (e.g., phenyl, tolyl, chlorophenyl, methoxyphenyl, acetamidophenyl, naphthyl), or —O—$R_4'$, wherein $R_4'$ represents a substituted or unsubstituted alkyl group having from 1 to 12 carbon atoms, a substituted or unsubstituted alkenyl group having from 1 to 12 carbon atoms, a substituted or unsubstituted aralkyl group having from 7 to 12 carbon atoms, a substituted or unsubstituted alicyclic group having from 5 to 18 carbon atoms, or a substituted or unsubstituted aryl group having from 6 to 18 carbon atoms; M represents Si, Ti, or Sn, and preferably Si.

In formula (I) wherein $L_1$ is —N=CH—$Q_1$ or

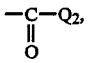

$Q_1$ and $Q_2$ each preferably represents a substituted or unsubstituted aliphatic group having from 1 to 18 carbon atoms, including an alkyl group, an alkenyl group, an aralkyl group, and an alicyclic group each of which may have a substituent (e.g., a halogen atom, —CN, an alkoxy group), or a substituted or unsubstituted aryl group having from 6 to 18 carbon atoms (e.g., phenyl, methoxyphenyl, tolyl, chlorophenyl, naphthyl).

In formula (I) wherein $L_1$ is

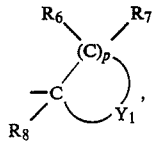

$Y_1$ represents an oxygen atom or a sulfur atom; $R_6$, $R_7$, and $R_8$, which may be the same or different, each preferably represents a hydrogen atom, a substituted or unsubstituted straight chain or branched alkyl group having from 1 to 18 carbon atoms (e.g., methyl, ethyl, propyl, butyl, hexyl, octyl, decyl, dodecyl, octadecyl, chloroethyl, methoxyethyl, methoxypropyl), a substituted or unsubstituted alicyclic group (e.g., cyclopentyl, cyclohexyl), a substituted or unsubstituted aralkyl group having from 7 to 12 carbon atoms (e.g., benzyl, phenethyl, chlorobenzyl, methoxybenzyl), a substituted or unsubstituted aromatic group (e.g., phenyl, naphthyl, chlorophenyl, tolyl, methoxyphenyl, methoxycarbonylphenyl, dichlorophenyl), or —O—$R_5'$, wherein $R_5'$ represents a hydrocarbon group, and, more specifically, the same groups as the hydrocarbon groups as represented by $R_6$, $R_7$, and $R_8$; and p represents 3 or 4.

In formula (I) wherein $L_1$ is

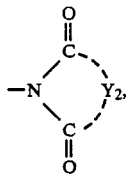

$Y_2$ represents an organic residual group forming a cyclic imido group, and preferably an organic residual group represented by formula (II) or (III):

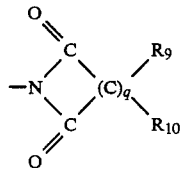

(II)

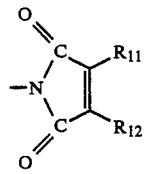

(III)

In formula (II), $R_9$ and $R_{10}$ (which may be the same or different) each represents a hydrogen atom, a halogen atom (e.g., chlorine, bromine), a substituted or unsubstituted alkyl group having from 1 to 18 carbon atoms (e.g., methyl, ethyl, propyl, butyl, hexyl, octyl, decyl, dodecyl, hexadecyl, octadecyl, 2-chloroethyl, 2-methoxyethyl, 2-cyanoethyl, 3-chloropropyl, 2-(methanesulfonyl) ethyl, 2-(ethoxyoxy)ethyl), a substituted or unsubstituted aralkyl group having from 7 to 12 carbon atoms (e.g., benzyl, phenethyl, 3-phenylpropyl, methylbenzyl, dimethylbenzyl, methoxybenzyl, chlorobenzyl, bromobenzyl), a substituted or unsubstituted alkenyl group having from 3 to 18 carbon atoms (e.g., allyl, 3-methyl-2-propenyl, 2-hexenyl, 4-propyl-2-pentenyl, 12-octadecenyl), —S—$R_6'$, wherein $R_6'$ represents the same alkyl, aralkyl or alkenyl group as represented by $R_9$ or $R_{10}$, a substituted or unsubstituted aryl group (e.g., phenyl, tolyl, chlorophenyl, bromophenyl, methoxyphenyl, ethoxyphenyl, ethoxycarbonylphenyl), or —$NHR_7'$, wherein $R_7'$ *has the same meaning as* $R_6'$, or $R_9$ and $R_{10}$ are taken together to form a ring, such as a 5- to 6-membered monocyclic ring (e.g., cyclopentyl, cyclohexyl) and a 5- to 6-membered bicylic ring (e.g., bicycloheptane, bicycloheptene, bicyclooctane, bicyclooctene) each of which have a substituent including the groups as represented by $R_9$ or $R_{10}$; and q represents 2 or 3.

In formula (111), $R_{11}$ and $R_{12}$, which may be the same or different, each has the same meaning as $R_9$ or $R_{10}$, Or $R_{11}$ and $R_{12}$ are taken together to form an organic residual group forming an aromatic ring (e.g., benzene ring, naphthalene ring).

In another preferred embodiment of this invention, the resin (A) is a resin containing at least one functional group represented by formula (IV)

$$-CO-L_2 \qquad \text{(IV)}$$

wherein $L_2$ represents

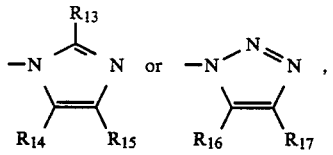

wherein $R_{13}$, $R_{14}$, $R_{15}$, $R_{16}$, and $R_{17}$ each represents a hydrogen atom or an aliphatic group.

In formula (IV), the aliphatic group as represented by $R_{13}$, $R_{14}$, $R_{15}$, $R_{16}$, Or $R_{17}$ preferably includes those enumerated for $R_6$, $R_7$, and $R_8$. $R_{14}$ and $R_{15}$, Or $R_{16}$ and $R_{17}$ together can form an organic residual group forming a condensed ring, preferably including a 5- to 6-membered monocyclic ring (e.g., cyclopentyl, cyclohexyl) or a 5- to 12-membered aromatic ring (e.g., benzene, naphthalene, thiophene, pyrrole, pyran, quinoline).

In a still another embodiment of this invention, the resin (A) is a resin containing at least one oxazolone ring represented by formula (V):

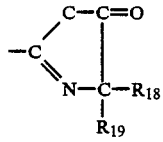

(V)

wherein $R_{18}$ and $R_{19}$, which may be the same or different, each represents a hydrogen atom or a hydrocarbon group, or $R_{18}$ and $R_{19}$ together form a ring.

In formula (V), $R_{18}$ and $R_{19}$, which may be the same or different, each preferably represents a hydrogen atom, a substituted or unsubstituted straight chain or branched alkyl group having from 1 to 12 carbon atoms (e.g., methyl, ethyl, propyl, butyl, hexyl, 2-chloroethyl, 2-methoxyethyl, 2-methoxycarbonylethyl, 3-hydroxypropyl), a substituted or unsubstituted aralkyl group having from 7 to 12 carbon atoms (e.g., benzyl, 4-chlorobenzyl, 4-acetamidobenzyl, phenethyl, 4-methoxybenzyl), a substituted or unsubstituted alkenyl group having from 2 to 12 carbon atoms (e.g., ethenyl, allyl, isopropenyl, butenyl, hexenyl), a substituted or unsubstituted 5- to 7-membered alicyclic group (e.g., cyclopentyl, cyclohexyl, chlorocyclohexyl), or a substituted or unsubstituted aromatic group (e.g., phenyl, chlorophenyl, methoxyphenyl, acetamidophenyl, methylphenyl, dichlorophenyl, nitrophenyl, naphthyl, butylphenyl, dimethylphenyl), or $R_{18}$ and $R_{19}$ together form a ring (e.g., tetramethylene, pentamethylene, hexamethylene).

The resin containing at least one functional group selected from the groups represented by formulae (I) and (IV) can be obtained by a process comprising converting a carboxyl group of a polymer into the functional group of formula (—COO—$L_1$) or (—CO—$L_2$) through a polymer reaction, or a process comprising polymerizing at least one monomer containing at least one functional group of formula (—COO—$L_1$) or (—CO—$L_2$) or copolymerizing such a monomer with other copolymerizable monomers.

For details of these processes, reference can be made to it, e.g., in Nihon Kagakukai (ed.), *Shinjikken Kaqaku Koza,* Vol. 14, "Yuki Kagobutsu no Gosei to Han-no (V)", 2535, Maruzen K.K., Y. Iwakura and K. Kurita, *Hannosei Kobunshi,* 170, Kodansha.

The latter process comprising polymerization of a monomer previously containing the functional group (—COO—$L_1$) or (—CO—$L_2$) is preferred to the former process because the functional group in the polymer can be controlled arbitrarily and the polymer is free from incorporation of impurities. In more detail, a carboxyl group(s) of a carboxylic acid or a halide thereof containing a polymerizable double bond and at least one carboxyl group is or are converted to the desired functional groups (—COO—$L_1$) or (—CO—$L_2$) and the resulting functional group-containing compound is polymerized.

The resin containing the oxazolone ring represented by formula (V) can be obtained by polymerizing at least one monomer containing the oxazolone ring or copolymerizing such a monomer with a copolymerizable monomer.

The monomer containing the oxazolone ring of formula (V) can be prepared by dehydrating cyclization reaction of N-acyloyl-α-amino acids containing a polymerizable unsaturated bond. For more details, reference can be made to Y. Iwakura and K. Kurita, *Hannosei Kobunshi,* Ch. 3, Kodansha.

Examples of the monomers copolymerizable with these functional group-containing monomers include vinyl or allyl esters of aliphatic carboxylic acids, e.g., vinyl acetate, vinyl propionate, vinyl butyrate, allyl acetate, allyl propionate, etc.; esters or amides of unsaturated carboxylic acids, e.g., acrylic acid, methacrylic acid, crotonic acid, itaconic acid, maleic acid, fumaric acid, etc.; styrene derivatives, e.g., styrene, vinyltoluene, α-methylstyrene, etc.; α-olefins; acrylonitrile, methacrylonitrile; and vinyl-substituted heterocyclic compounds, e.g., N-vinylpyrrolidone, etc.

The copolymer component containing the functional group of formulae (I) to (V) which can be used in the aforesaid polymerization process specifically includes those represented by formula (VI).

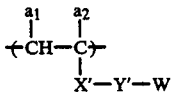

(VI)

wherein X' represents —O—, —CO—, —COO—, —OCO—,

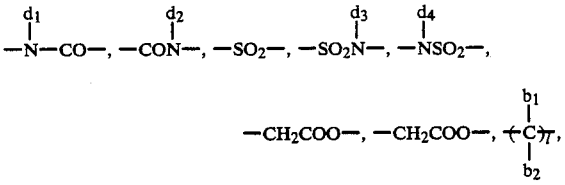

an aromatic group, or a heterocyclic group, (Y'—W) in formula (VI); $b_1$ and $b_2$, which may be the same or different each represents a hydrogen atom, a hydrocarbon group, or the group (Y'—W) in formula (VI); and l represents 0 or an integer of from 1 to 18; Y' represents a carbon-carbon bond for linking X' and W, and Y' may contain a hetero atom (e.g., oxygen, sulfur, or nitrogen); W represents any of the functional groups represented by formulae (I) to (IV); and $a_1$ and $a_2$ (which may be the same or different) each represents a hydrogen atom, a halogen atom (e.g., chlorine, bromine), a cyano group, a hydrocarbon group, such as a substituted or unsubstituted alkyl group having from 1 to 12 carbon atoms (e.g., methyl, ethyl, propyl, butyl, methoxycarbonyl, ethoxycarbonyl, propoxycarbonyl, butoxycarboxyl, hexyloxycarbonyl, methoxycarbonylmethyl, ethoxycarbonylmethyl, butoxycarboxymethyl), an aralkyl group (e.g., benzyl, phenethyl), an aryl group (e.g., phenyl, tolyl, xylyl, chlorophenyl), and an alkyl (containing 1 to 18 carbon atoms), alkenyl, aralkyl, alicyclic or aromatic group which may be substituted with a substituent containing —W in formula (VI); OR —X'—Y'— represents a chemical bond directly linking

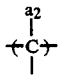

and —W.

In formula (VI), the linking group as represented by Y' is composed of one or more of divalent groups, e.g.,

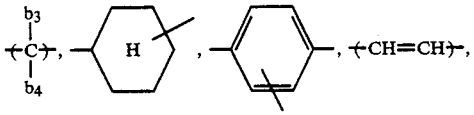

—O—, —S—, —N—, —COO—, —CONH—, $—SO_2—$, $—SO_2NH—$, —NHCOO—, —NHCONH—, etc., wherein $b_3$, $b_4$, and $b_5$ have the same meanings as $b_1$ and $b_2$.

Specific but non-limitative examples of the functional group represented by formulae (I) to (V) or by symbol W in formula (VI) are shown below:

(1)

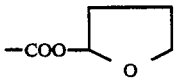

(2)

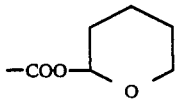

(3)

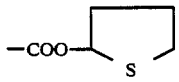

(4)

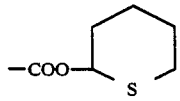

(5)

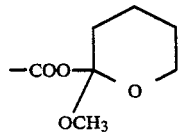

(6)

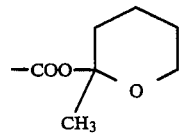

(7)

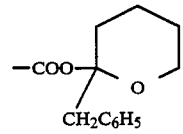

(8)

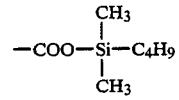

(9)

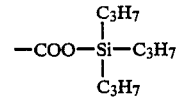

(10)

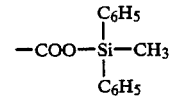

(11)

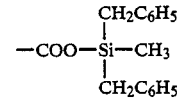

(12)

$—COOCH_2CF_3$ (13)

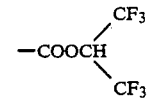

(14)

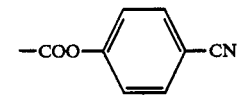

-continued
(15)
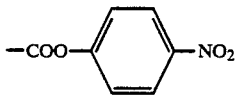
(16)
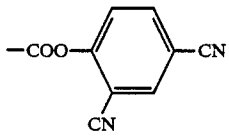
(17)
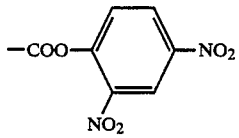
(18)
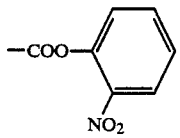
(19)
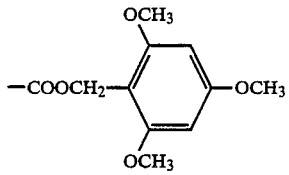
(20)
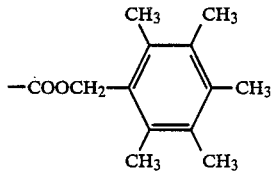
(21)
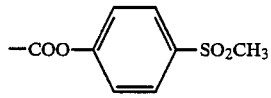
(22)
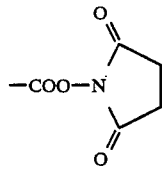
(23)
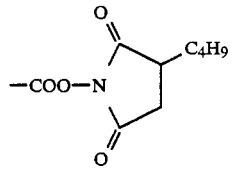
(24)
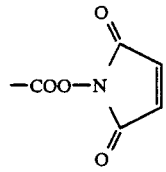
-continued
(25)
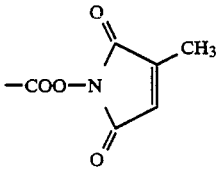
(26)
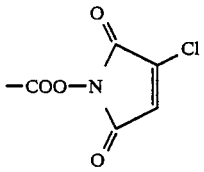
(27)
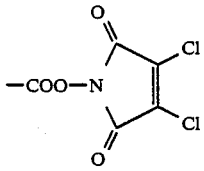
(28)
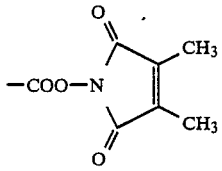
(29)
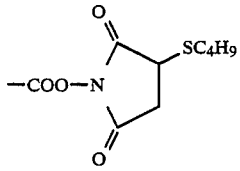
(30)
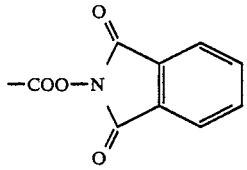
(31)
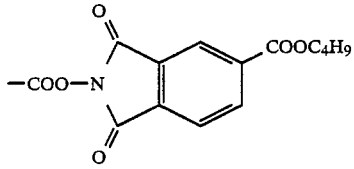
(32)
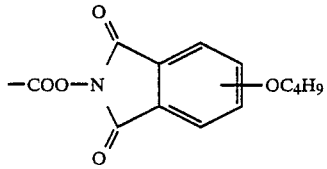
(33)
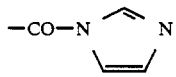
(34)
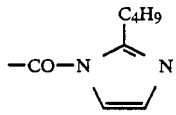

-continued (35)

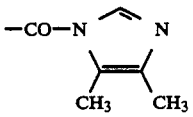

(36)

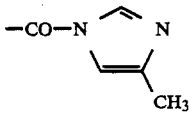

(37)

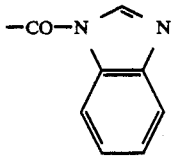

(38)

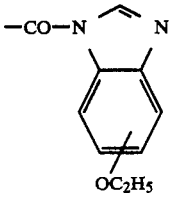

(39)

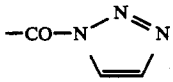

(40)

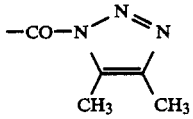

(41)

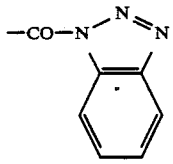

(42)

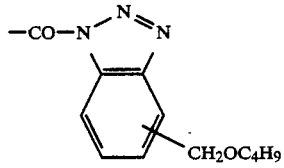

(43)

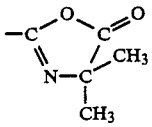

(44)

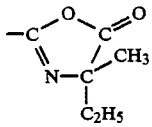

(45)

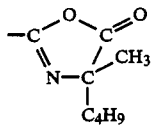

-continued (46)

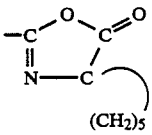

(47)

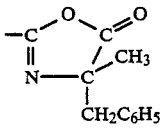

(48) $-COOCH_2OCH_3$ (49)

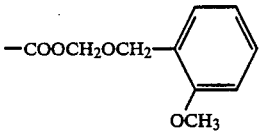

(50) $-COOC(C_6H_5)_3$

(51) $-COOCH(C_6H_5)_2$ (52)

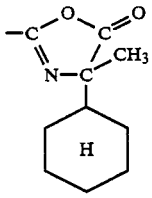

When the carboxyl-forming functional group-containing resin (A) is a copolymer, the proportion of the polymer component containing the carboxyl-forming functional group in the copolymer is preferably from 0.1 to 95% by weight, and more preferably from 0.5 to 70% by weight. The resin (A) preferably has a molecular weight ranging from $1\times10^3$ to $1\times10^6$, and more preferably from $5\times10^3$ to $5\times10^5$.

In order to enhance cross-linking effects between the resin (A) and the resin (B) and/or the cross-linking agent (C), the resin (A) can contain a copolymer component containing a functional group which undergoes cross-linking reaction with the resin (B) and/or the cross-linking agent (C) upon heating or irradiation of light. Such a functional group includes a group having at least one dissociative hydrogen atom, e.g., —OH, —SH, —NHR, wherein R represents an alkyl group having up to 8 carbon atoms (e.g., methyl, ethyl, propyl, butyl, hexyl) or an aryl group (e.g., phenyl, tolyl, methoxyphenyl, butylphenyl); an epoxy group, a thioepoxy group, etc. The proportion of the copolymer component containing the above-described functional group in the resin (A) preferably ranges from 1 to 20% by weight, and more preferably from 3 to 10% by weight.

Monomers providing such a copolymer component include vinyl compounds containing the above-recited cross-linkable functional group which are copolymerizable with the carboxyl-forming functional group-containing polymer component in the resin (A), for example, the compounds of formula (VI).

These vinyl compounds are described, e.g., in Polymer Society (ed.), *Kobunshi Data Handbook* (*Kiso-hen*), Baihukan (1986). Specific examples of the vinyl compounds include acrylic acid, α- and/or β-substituted acrylic acids (e.g., α-acetoxyacrylic acid, α-acetoxymethylacrylic acid, α-(2-aminom)methylacrylic acid, α-chloroacrylic acid, α-bromoactylic acid, α-fluoroacrylic acid, α-tributylsilylacrylic acid, α-cyanoacrylic acid, β-chloroacrylic acid, β-bromoacrylic acid, α-chloro-β-methoxyacrylic acid, α,β-dichloroacrylic acid), methacrylic acid, itaconic acid, itaconic acid half esters, itaconic acid half amides, crotonic acid, 2-alkenylcarboxylic acid (e.g., 2-pentenoic acid, 2-methyl-2-hexenoic acid, 2-octenoic acid, 4-methyl-2-hexenoic acid, 4-ethyl-2-octenoic acid), maleic acid, maleic acid half esters, maleic acid half amides, vinylbenzenecarboxylic acid, vinylbenzenesulfonic acid, vinylsulfonic acid, vinylphosphonic acid, vinyl or allyl half esters of dicarboxylic acids, and ester or amide derivatives of these carboxylic acids or sulfonic acids having the aforesaid functional group in the substituent thereof. More specific examples are the compounds of formula (VI) containing the aforesaid cross-linkable functional group in the substituents thereof.

If desired, in addition to the monomer component having any of the functional groups of formulae (I) to (V) and the above-described optional comonomer component containing the cross-linkable functional group, the resin (A) may further contain other copolymer components. Examples of such copolymer components include α-olefins, alkanoic acid vinyl or allyl esters, acrylonitrile, methacrylonitrile, vinyl ethers, acrylamides, methacrylamides, styrenes, heterocyclic vinyl compounds (e.g., vinylpyrrolidone, vinylpyridine, vinylimidazole, vinylthiophene, vinylimidazoline, vinylpyrazole, vinyldioxane, vinylquinoline, vinylthiazole, vinyloxazine). From the standpoint of film strength, vinyl acetate, allyl acetate, acrylonitrile, methacrylonitrile, and styrenes are particularly preferred.

The above-described resin (A) can be used either individually or in combination of two or more thereof.

The resin (B) for use in this invention is a known curable resin which undergoes cross-linking reaction by heat and/or light, and preferably a resin capable of cross-linking with the functional group in the resin (A).

The heat-curable resin is described, e.g., in T. Endo, *Netsukokasei Kobunshi no Seimitsuka,* C.M.C. (1986), Y. Harasaki, *Saishin Binder Gijutsu Binran,* Ch. II-1, Sogo Gijutsu Center (1985), T. Ohtsu, *Akuriru Jushi no Gosei Sekkei to Shin-yoto Kaihatsu,* Tyubu Keiei Kaihatsu /Center Shuppan-bu (1985), and E. Ohmori, *Kinosei Akuriru-kei Jushi,* Techno System (1985). Examples of the heat-curable resin include polyester resins, modified or unmodified epoxy resins, polycarbonate resins, vinyl alkanoate resins, modified polyamide resins, phenolic resins, modified alkyd resins, melamine resins, acrylic resins, and isocyanate resins.

The photo-curable resin is described, e.g., in H. Inui and G. Nagamatsu, *Kankosei Kobunshi,* Kodansha (1977), T. Tsunoda, *Shin-kankosei Jushi,* Insatsu Gakkai Shuppan-bu (1981), G. E. Green and B. P. Stark, *J. Macro. Sci. Reas. Macro Chem.,* C 21(2), 187–273 (1981–1982), and C. G. Rattey, *Photopolymerization of surface Coatinqs,* A. Wiley Interscience Publ. (1982).

In more detail, the resin (B) includes a polymer containing a functional group capable of cross-linking by heating or irradiation of light. Implicit in such a cross-linkable functional group are those of type which undergo chemical bonding with different kinds of functional groups and self-cross-linkable functional groups. For example, the functional groups of the former type are selected from each of Group I and Group II tabulated below.

| Group I | Group II |
|---|---|
| Functional groups having a dissociative hydrogen atom: | Functional groups capable of chemical bonding to the group of Group I: |
| —OH, —SH, —$NHR_{21}$ (wherein $R_{21}$ is the same as the hydrocarbon group as for $R_3$) | 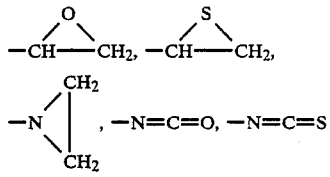 |
| —COOH, —$PO_3H_2$ | Cyclic dicarboxylic acid anhydride groups |

The self-cross-linkable functional groups include —$CONHCH_2OR_{22}$, wherein $R_{22}$ is a hydrogen atom, an alkyl group having from 1 to 6 carbon atoms (e.g., methyl, ethyl, propyl, butyl, hexyl), and a group having a polymerizable double bond represented by formula (A).

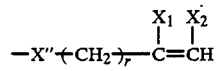

(A)

wherein X″ represents —COO—, —OCO—, —CO—, —$SO_2$—, —CONH—, —$SO_2NH$—, —O—, —S—, an aromatic group, or a heterocyclic group; $x_1$ *l and x2* (which may be the same or different) each represents a hydrogen atom or a substituted or unsubstituted hydrocarbon group (e.g., methyl, ethyl, propyl, butyl, hexyl, carboxymethyl, methoxycarbonylmethyl, ethoxycarbonylmethyl, butoxycarbonylmethyl, 2-chloroethyl, 2-methoxyethyl, ethoxymethyl, benzyl, phenethyl, 3-phenylpropyl, chlorobenzyl, bromobenzyl, methylbenzyl, methoxybenzyl, phenyl, tolyl, xylyl, methoxyphenyl, chlorophenyl, bromophenyl); and r represents 0 or 1.

Monomers providing the copolymer component containing these cross-linkable functional groups include vinyl compounds containing such functional groups, and more specifically the compounds described as for the resin (A). Monomers providing other copolymer components which are copolymerized with the cross-linkable functional group-containing copolymer component include those enumerated as for the resin (A).

It is preferable that the resin (B) contains from 1 to 80 by weight of the cross-linkable functional group-containing copolymer component. The resin (B) preferably has a weight average molecular weight of from $1\times10^3$ to $5\times10^5$, and more preferably from $5\times10^3$ to $5\times10^5$.

In cases wherein the resin binder according to the present invention comprises the resin (A) and the resin (B), cross-linking reaction takes place between the resin (A) and the resin (B) and/or self-cross-linking reaction takes place among the molecules of the resin (B). In these cases, the ratio of the resin (A) to resin (B) preferably ranges from 5/95 to 80/20 by weight, and more preferably from 15/85 to 60/40 by weight.

The cross-linking agent which can be used in combination with the resin (A) is selected from compounds commonly employed as cross-linking agent. Examples of usable cross-linking agents are described, e.g., in S. Yamashita and T. Kaneko (ed.), *Kakyozai Handbook,* Taiseisha (1981) and Kobunshi Gakkai (ed.), *Kobunshi Data Handbook (Kiso-hen),* Baihukan (1986). Specific examples are organosilane compounds such silane coupling agents (e.g., vinyltrimethoxysilane, vinyltributoxysilane, γ-glycidoxypropyltrimethoxysilane, γ-mercaptopropyltriethoxysilane, γ-aminopropyltriethoxysilane), polyisocyanate compounds (e.g., toluylene diisocyanate, o-toluylene diisocyanate, diphenylmethane diisocyanate, triphenylmethane triisocyanate, polymethylene polyphenyl isocyanate, hexamethylene diisocyanate, isophorone diisocyanate, high-molecular polyisocyanates), polyol compounds (e.g., 1,4-butanediol, polyoxypropylene glycol, polyoxyalkylene glycols, 1,1,1-trimethylolpropane), polyamine compounds (e.g., ethylenediamine, γ-hydroxypropylated ethylenediamine, phenylenediamine, hexamethylenediamine, N-aminoethylpiperazine, modified aliphatic polyamines), polyepoxy-containing compounds and epoxy resins [e.g., the compounds described in H. Kakiuchi (ed.), *Shin-epoxy Jushi,* Shokodo (1985), and K. Hashimoto (ed.), *Epoxy Jushi,* Nikkan Kogyo Shinbunsha (1969)], melamine resins [e.g., the compounds described in I. Miwa and H. Matsunaga (ed.), *Urea Melamine Jushi,* Nikkan Kogyo Shinbunsha (1969)], and polyfunctional monomer compounds having at least two polymerizable double bonds [e.g., the compounds described in S. Ohgawara, T. .Saegusa, and T. Higashimura (ed.), *Oligomer,* Kodansha (1976), and E. Ohmori, *KJinosei Akuriru-kei Jushi,* Techno System (1985)]. Specific examples of these cross-linking agents are divinylbenzene, divinylglutaconic acid diesters, vinyl methacrylate, allyl methacrylate, ethylene glycol dimethacrylate, polyethylene glycol diacrylate, neopentylglycol diacrylate, 1,6-hexanediol diacrylate, trimethylolpropane triacrylate, pentaerythritol polyacrylate, bisphenol A diglycidiyl ether diacrylate, oligoester acrylates; and the corresponding methacrylates.

The content of the cross-linking agent (C) in the resin binder preferably ranges from 0.1 to 30% by weight, and more preferably from 0.5 to 20% by weight.

The resin binder according to the present invention contain either one or both of the resin (B) and the cross-linking agent (C). If desired, the resin binder may further contain a reaction accelerator. For example, in the case where the resin binder contains the resin (B) containing a heat-curable functional group, an acid, e.g., an organic acid (e.g., acetic acid, propionic acid, butyric acid) may be added as a reaction accelerator.

In the case where the resin binder contains the resin (B) containing a photo-cross-linkable functional group, the resin binder may further contain a sensitizer, a photopolymerizable monomer, and the like. Specific examples of these components are described in the references cited above with respect to photosensitive resins.

A photosensitive coating composition comprising zinc oxide and the resin binder of the invention is coated on a support and then subjected to cross-linking reaction by heating or irradiation of light. When the resin binder is heat-curable, the cross-linking is preferably carried out by drying the photosensitive coating at a high temperature and/or for a long time, or further heating the dried photosensitive coating, e.g., at 60° to 120° C. for 5 to 120 minutes. When the resin binder contains the photo-cross-linkable resin (B), the cross-linking can be induced by irradiating electron rays, X-rays, ultraviolet rays, or plasma beams. Such photo-cross-linking may be conducted either during drying or before or after the drying. The photo-cross-linking reaction can be accelerated by heating under the above-described drying conditions.

The cross-linking reaction proceeds under mild conditions when the resin binder contains both the resin (B) and the cross-linking agent, or when the above-described reaction accelerator is used in combination, or when the resin (A) contains the above-described cross-linkable functional group.

It is essential that the cross-linking should take place at least between resins of the present invention, but it may take place among other resins.

It is preferable that the resin binder of the present invention becomes sparingly soluble or insoluble in an acidic or alkaline aqueous solution when it decomposes to form carboxyl groups.

In combination with the resin binder of the present invention, conventionally known resins may be used. Usable known resins include the above-described silicone resins, alkyd resins, vinyl acetate resins, polyester resins, styrene-butadiene resins, and acrylic resins. Specific examples of these resins are described in T. Kurita and J. Ishiwatari, *Kobunshi,* Vol. 17, 278 (1968) and H. Miyamoto and H. Takei, *Imaging,* No. 8, 9 (1973).

The photoconductive layer of the lithographic printing plate precursor according to the present invention usually comprises from 10 to 60 parts by weight, and preferably from 15 to 40 parts by weight, of the resin binder, per 100 parts by weight of photoconductive zinc oxide.

In the case when a conventional resin binder containing a carboxyl group from the first is employed in the production of lithographic printing plate precursors, a dispersion of zinc oxide in this resin has an increased viscosity so that the photoconductive layer formed by coating such a dispersion seriously deteriorates smoothness or insufficient film strength, and is also unsatisfactory in electrophotographic characteristics. Even if a printing plate precursor having sufficient smoothness might be obtained, stains tend to be formed during printing. Carboxyl groups contained in the conventional resin may be adjusted so as to produce a printing plate precursor which can reproduce a satisfactory image and provide a satisfactory print, but the quality of the reproduced image of the precursor is subject to deterioration due to changes of environmental conditions. That is, if the environmental condition during electrophotographic image formation processing is changed to a low temperature and low humidity condition or a high temperature and high humidity condition (particularly, to a high temperature and high humidity condition), the reproduced image suffers from background fog, reduction in density of image areas, or disappearance of fine lines or letters.

These unfavorable phenomena accompanied by the conventional lithographic printing plate precursors are presumably attributed to the following reasons.

Since the interaction between carboxyl groups in the resin binder and surfaces of photoconductive zinc oxide particles is strong, the resin adsorption on the surfaces of zinc oxide particles increases. As a result, compatibility of the photoconductive layer with an oil-desensitizing solution or dampening water is impaired. Otherwise, even when the carboxyl groups in the resin binder may be adjusted adequately with respect to zinc oxide particles, the hydrophilic atmosphere on the boundaries between the carboxyl groups in the resin and the zinc oxide particles greatly changes upon exposure to a low-temperature and low-humidity condition or a high-temperature and high-humidity condition so that electrophotographic characteristics, such as surface potential or dark decay after charging, are deteriorated.

The resin binder according to the present invention and the known resins may be used at an arbitrary mixing ratio, but it is desirable the proportion of the carboxyl-forming functional group-containing resin (A) in the total resin should be in the range of from about 1 to 90% by weight, and, particularly when the binder contains the resin (B), from about 0.5 to 70% by weight.

If the content of the resin (A) in the total resin is less than the lower limit recited above, the resulting lithographic printing plate shows insufficient hydrophilic properties after oil-desensitization with an oil-desensitizing solution or dampening water, causing stains on printing. On the other hand, if it exceeds the upper limit recited above, the lithographic printing plate precursor has poor image-forming properties.

The resin (A) according to the present invention which contains at least one functional group capable of forming a carboxyl group is hydrolyzed or hydrogenolyzed upon contact with an oil-desensitizing solution or dampening water used on printing to thereby form a carboxyl group. Therefore, when the resin (A) is used as a binder for a lithographic printing plate precursor, hydrophilic properties of non-image areas attained by processing with an oil-desensitizing solution can be enhanced by the thus formed carboxyl groups. As a result, a marked contrast can be afforded between lipophilic properties of image areas and the hydrophilic properties of non-image areas, to prevent adhesion of a printing ink onto the non-image areas during printing. It has thus been realized to provide a lithographic printing plate capable of producing a larger number of prints having a clear image free from background stains as compared with lithographic printing plates prepared by using conventional resin binders.

Further, since the resin binder of the invention contains the cross-linking agent and/or resin (B) which undergoes cross-linking with the resin (A), cross-linking reaction takes place during the formation of a photoconductive layer or heating and/or light irradiation before etching, to form a cross-linked structure between high-molecular weight polymers.

The resin containing a carboxyl group formed on decomposition is rendered hydrophilic by etching treatment or treating with dampening water during printing, and, with a high content of such a resin, the resin binder becomes water-soluble. However, since the resin binder of the present invention has a cross-linked structure formed by cross-linking with the resin (B) and/or the cross-linking agent, the binder becomes sparingly water soluble or water-insoluble while retaining hydrophilic properties. Therefore, the effects of the carboxyl group formed in the resin to impart hydrophilic properties to the non-image areas are further ensured by such a cross-linked structure, thereby improving printing durability of the printing plate.

Describing these effects more specifically, the present invention makes it possible to maintain the effects of improving hydrophilic properties even if the proportion of the functional group-containing resin in the total resin binder is decreased, or to produce a large number of clear prints free from background stains even if printing conditions are made more strict through an increase of a printing machine in size or a variation of printing pressure.

If desired, the photoconductive layer may further contain various dyes as spectral sensitizers, such as carbonium dyes, diphenylmethane dyes, triphenylmethane dyes, xanthene dyes, phthalein dyes, polymethine dyes (e.g., oxonol dyes, merocyanine dyes, cyanine dyes, rhodacyanine dyes, styryl dyes), and phthalocyanine dyes inclusive of metallized phthalocyanine dyes, as described, e.g., in H. Miyamoto and H. Takei, *Imaging,* No. 8, 12 (1973); C.J. Young, et al., *RCA Review,* Vol. 15, 469 (1954); K. Kiyota, et al., *Denki Tsushin Gakkai Ronbunshi J* 63-*C, No.* 2, 97 (1980); Y. Harasaki, *Kogyo Kagaku Zasshi,* Vol. 66, 78 and 188 (1963); and T. Tani, *Nippon Shashin Gakkaishi,* Vol. 35, 208 (1972).

More specifically, carbonium dyes, triphenylmethane dyes, xanthene dyes, and phthalein dyes are described, e.g., in JP-B-51-452, JP-A-50-90334, 50-114227, 53-39130, and 53-82353, U.S. Pat. Nos. 3,052,540 and 4,054,450, and JP-A-57-16456. Polymethine dyes, e.g., oxonol dyes, merocyanine dyes, cyanine dyes, and rhodacyanine dyes are described, e.g., in F. M. Harmmer, *The Cyanine Dyes and Related Compound.* Specific examples of these polymethine dyes are described, e.g., in U.S. Pat. Nos. 3,047,384, 3,110,591, 3,121,008, 3,125,447, 3,128,179, 3,132,942, and 3,622,317, British Pat. Nos. 1,226,892, 1,309,274, and 1,405,898, and JP-B-48-7814 and 55-18892. Polymethine dyes which spectrally sensitize the near infrared to infrared regions of wavelengths longer than 700 nm are described, e.g., in JP-A47-840 and 47-44180, JP-B-51-41061, JP-A-49-5034, 49-45122, 57-46245, 56-35141, 57-157254, 61-26044, and 61-27551, U.S. Pat. Nos. 3,619,154 and 4,175,956, and *Research Disclosure,* 216, 117–118 (1982).

The photoconductive layer of the present invention is excellent in that the performance properties are not liable to variation due to the sensitizing dyes used.

The photoconductive layer may furthermore contain various additives known for use in electrophotographic photosensitive layers, such as chemical sensitizers. Examples of such additives include electron accepting compounds (e.g., halogen, benzoquinone, chloranil, acid anhydrides, organic carboxylic acids) as described in *Imaging,* No. 8, 12 (1973), and polyarylalkane compounds, hindered phenol compounds, and p-phenylenediamine compounds as described in H. Kokado, et al., *Saikin no Kododen Zairyo to Kankotai no Kaihatsu Jitsuvoka,* Chs. 4–6, Nippon Kagaku Joho, Shuppan-bu (1986). The amount of these additives is not particularly limited, but usually ranges from 0.0001 to 2.0 parts by weight per 100 parts by weight of a photoconductive substance.

The photoconductive layer can be provided on any known support, usually to a thickness of from 1 to 100 μm, and preferably from 10 to 50 μm. In general, the support for an electrophotographic photosensitive layer is preferably electrically conductive. Any of conventionally employed conductive supports may be utilized in this invention. Examples of usable conductive supports include a base material (e.g., a metal sheet, paper, a plastic sheet) having been rendered electrically conductive by, for example, impregnating with a low resistant substance; a base material with its back side (i.e., the side opposite to the photosensitive layer) being rendered conductive and further coated thereon at least one layer for preventing curling, etc.; the aforesaid supports having further provided thereon a water-resistant adhesive layer; the aforesaid supports having further provided thereon at least one precoat layer; and paper laminated with a plastic film on which aluminum, etc. is deposited.

Specific examples of the conductive supports and materials for imparting conductivity are described in S. Sakamoto, *Denshishashin*, Vol. 14, No. 1, 2–11 (1975), H. Moriga, *Nyumon Tokushushi no Kagaku*, Kobunshi Kankokai (1975), and M. F. Hoover, *J. Macromol. Sci. Chem.*, A-4(6), 1327–1417 (1970).

The present invention will now be illustrated in greater detail by way of examples, but it should be understood that the present invention is not deemed to be limited thereto. In these examples, all the ratios are by weight unless otherwise specified.

EXAMPLE 1

A mixed solution consisting of 47 g of butyl methacrylate, 13 g of 2-hydroxyethyl methacrylate, 40 g of a monomer compound (i) of the formula

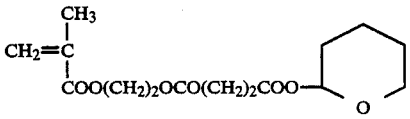

and 200 g of toluene was heated to 70° C. under a nitrogen stream, and 1.5 g of azobisisobutyronitrile (AIBN) was added thereto, followed by allowing to react for 8 hours. The resulting copolymer was designated as (A-1). The copolymer (A-1) had a weight average molecular weight (Mw) of 48,000.

A mixture of 25 g (solids content) of (A-1), 15 g of an ethyl methacrylate/acrylic acid copolymer (98.5/1.5; Mw=45,000), 200 g of zinc oxide, 0.05 g of Rose Bengale, 0.01 g of succinic anhydride and 300 g of toluene was dispersed in a ball mill for 2 hours. To the dispersion was added 6 g of hexamethylene diisocyanate, and the mixture was further dispersed in a ball mill for 10 minutes to prepare a photosensitive coating composition. The composition was coated on paper having been rendered electrically conductive to a dry coverage of 21 g/m$^2$ with a wire bar, followed by drying at/10° C. for 1 minute. The photosensitive layer was then allowed to stand in a dark place at 20° C. and 65% RH (relative humidity) for 24 hours to produce an electrophotographic lithographic printing plate precursor.

COMPARATIVE EXAMPLE 1

A mixed solution consisting of 60 g of butyl methacrylate, 13 g of 2-hydroxyethyl methacrylate, 40 g of the monomer compound (i), and 200 g of toluene was heated to 70° C. under a nitrogen stream, and 1.5 g of AIBN was added thereto. The mixture was allowed to react for 8 hours. The resulting copolymer had an Mw of 45,000.

A mixture of 30 g (solids content) of the resulting copolymer, 10 g of an ethyl methacrylate/acrylic acid copolymer (98.5/1.5; Mw=45,000), 200 g of zinc oxide, 0.05 g of Rose Bengale, 0.01 g of phthalic anhydride, and 300 g of toluene was dispersed in a ball mill for 2 hours to prepare a photosensitive coating composition. The composition was coated on paper having been rendered conductive to a dry coverage of 25 g/m$^2$ with a wire bar, followed by drying at 110° C. for 1 minute. The photosensitive layer was then allowed to stand in a dark place at 20° C. and 65% RH for 24 hours to produce an electrophotographic lithographic printing plate precursor.

COMPARATIVE EXAMPLE 2

A mixed solution consisting of 87 g of butyl methacrylate, 13 g of 2-hydroxyethyl methacrylate, and 200 g of toluene was subjected to polymerization reaction in the same manner as in Example 1. The resulting copolymer had an Mw of 46,000.

An electrophotographic lithographic printing plate precursor was produced in the same manner as in Example 1, except for using the above prepared copolymer in place of (A-1).

COMPARATIVE EXAMPLE 3

An electrophotographic lithographic printing plate precursor was produced in the same manner as in Comparative Example 1, except for using 40 g of an ethyl methacrylate/acrylic acid copolymer (98.5/1.5; Mw=45,000) as a resin binder.

Each of the lithographic printing plate precursors obtained in Example 1 and Comparative Examples 1 to 3 was evaluated for film properties in terms of surface smoothness, electrostatic characteristics, oil-desensitization of the photoconductive layer in terms of contact angle with water after oil-desensitization, and printing performances in terms of stain resistance in accordance with the following test methods.

(1) Smoothness of Photoconductive Layer:

The smoothness (sec/cc) was measured by means of a Beck smoothness tester manufactured by Kumagaya Riko K.K. under a condition of an air volume of 1 cc.

(2) Electrostatic Characteristics:

The sample was negatively charged by corona discharge to a voltage of −6 kV for 20 seconds in a dark room at 20° C. and 65% RH using a paper analyzer ("Paper Analyzer SP-428" manufactured by Kawaguchi Denki K.K.). After the sample was allowed to stand for 10 seconds, the surface potential $V_0$ was measured. Then, the photoconductive layer was irradiated with visible light at an illumination of 2.0 lux, and the time required to reduce the surface potential $V_0$ to one-tenth was measured. The exposure amount $E_{1/10}$ (lux.sec) was then calculated therefrom.

(3) Contact Angle With Water:

The sample was passed once through an etching processor using an oil-desensitizing solution ("ELP-E" produced by Fuji Photo Film Co., Ltd.) to oil-desensitize the surface of the photoconductive layer. On the thus oil-desensitized surface was placed a drop of 2 μl of distilled water, and the contact angle formed between the surface and water was measured by a goniometer.

(4) Image Quality:

The sample was allowed to stand under an ambient condition of 20° C., 65% RH (hereinafter referred to as Condition I) or a high-temperature and high-humidity condition of 30° C. and 80% RH (hereinafter referred to as Condition II) for a whole day and then processed using an automatic camera processor "ELP 404V" (manufactured by Fuji Photo Film Co., Ltd.) which had also been allowed to stand under Condition I or II, respectively. The image reproduced on the resulting printing plate was visually evaluated in terms of fog and image quality.

(5) Background Stain:

The sample was processed with ELP 404V to form a toner image, and the surface of the photoconductive layer was subjected to oil-desensitization under the same conditions as in (3) above. The resulting printing plate was mounted on an offset printing machine "Hamada Star 800SX" manufactured by Hamada Star K.K.), and printing was carried out on fine paper in a conventional manner (hereinafter referred to as Condition I) to obtain 500 prints. All the resulting prints were visually evaluated for background stains.

The same evaluation was repeated, except that the printing was carried out under more severe conditions, i.e., by using a 5-fold diluted oil-desensitizing solution and a 2-fold diluted dampening water for printing, and that the printing pressure applied was made higher (hereinafter referred to as Condition II).

In Tables 1 and 4 below, the quality of the reproduced image and the background stain were evaluated according to the following rating:

Quality of Reproduced Image

Good: clear image without background stain
Fair: slight background stains
Poor: many background stains and deficient fine lines and letters
Very Poor: substantial amount of background stains and decreased density in the image area and deficient letters Background Stain Good: no background stain
Fair: slight dot-like background stains
Poor: many dot-like background stains The results of these evaluations are shown in Table 1 below.

TABLE 1

| | Example 1 | Compar. Example 1 | Compar. Example 2 | Compar. Example 3 |
|---|---|---|---|---|
| Smoothness of Photoconductive Layer (sec/cc) | 85 | 85 | 80 | 73 |
| Electrostatic Characteristics: | | | | |
| $V_0$ (−V) | 530 | 535 | 520 | 500 |
| $E_{1/10}$ (lux. sec) | 8.5 | 8.3 | 8.5 | 9.2 |
| Contact Angle with Water | 5 or less | 5 or less | 18 | 18 to 30 (widely scattered) |

TABLE 1-continued

| | Example 1 | Compar. Example 1 | Compar. Example 2 | Compar. Example 3 |
|---|---|---|---|---|
| (degree) | | | | |
| Quality of Reproduced Image: | | | | |
| Condition I | good | good | good | fair to good |
| Condition II | good | good | poor | very poor |
| Background Stain: | | | | |
| Condition I | good | good | good | poor to fair |
| Condition II | more than 10,000 prints free from stains | stains observed from the 7,000th print | stains observed from the 3,000th print | stains observed from the start of printing |

From the results of Table 1, the following considerations can be derived.

The printing plate obtained by using any of the photosensitive material containing the resin (A) and cross-linking agent (C) according to the present invention and the comparative photosensitive materials had a clear reproduced image when processed under an ambient condition (Condition I), but the reproduced image of the samples of Comparative Example 3 suffered from defects such as disappearance of fine lines or dots. When processed under a high-temperature and high-humidity condition (Condition II), the reproduced image of Comparative Examples 2 and 3 suffered from serious deterioration. . Namely, the image underwent background fog and had a density of 0.6 or less.

The samples of Example 1 and Comparative Example 1 showed a contact angle with water as small as 5° or less, indicating that the surface of the photoconductive layer was rendered sufficiently hydrophilic.

When each of the printing plates was used as a master plate for offset printing, only those of Example 1 and Comparative Example 1 proved excellent in resistance to background stains. When printing was carried out under a higher printing pressure, the 10,000th print obtained in Example 1 had satisfactory image quality and was free from background stains, whereas the plates of Comparative Examples 1 and 2 caused appreciable background stains from about the 7,000th print and from about 3,000th print, respectively. The printing plate of Comparative Example 3 caused serious background stains from the very start of printing.

It is thus seen that only the photosensitive material according to the present invention always reproduces a clear image irrespective of a variation of environmental conditions during processing and provides a printing plate with which more than 10,000 stain-free prints can be obtained.

EXAMPLES 2 TO 17

An electrophotographic lithographic printing plate precursor was produced in the same manner as in Example 1, except for replacing (A-1) with each of the copolymer resins shown in Table 2 below.

TABLE 2
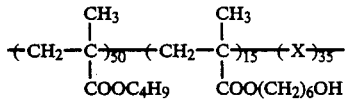
(Copolymerization Ratio: % by weight)
| Example No. | Resin (A) | X in Formula Above | Mw |
|---|---|---|---|
| 2 | (A-2) | 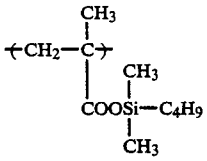 | 35,000 |
| 3 | (A-3) | 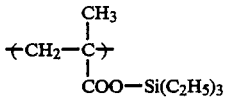 | 40,000 |
| 4 | (A-4) | 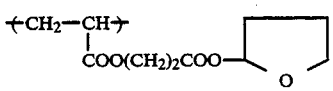 | 32,000 |
| 5 | (A-5) | 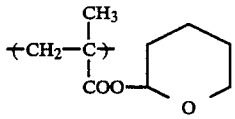 | 36,000 |
| 6 | (A-6) | 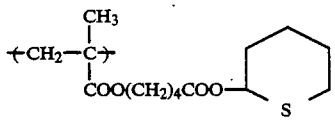 | 28,000 |
| 7 | (A-7) | 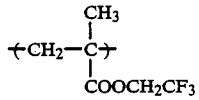 | 38,000 |
| 8 | (A-8) | 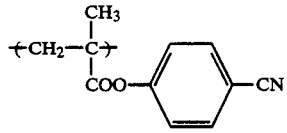 | 42,000 |
| 9 | (A-9) | 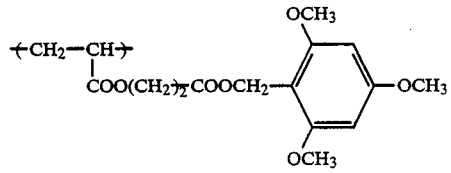 | 51,000 |
| 10 | (A-10) | 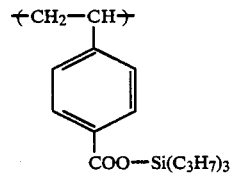 | 27,000 |
| 11 | (A-11) | 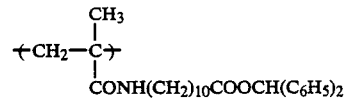 | 21,000 |

TABLE 2-continued

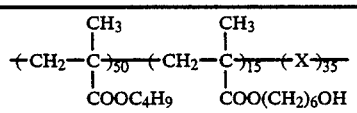

(Copolymerization Ratio: % by weight)

| Example No. | Resin (A) | X in Formula Above | Mw |
|---|---|---|---|
| 12 | (A-12) | 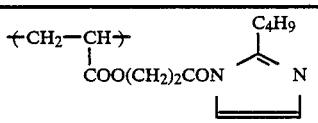 | 15,000 |
| 13 | (A-13) | 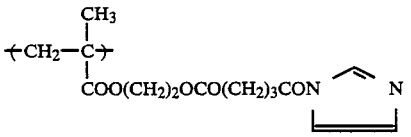 | 32,000 |
| 14 | (A-14) | 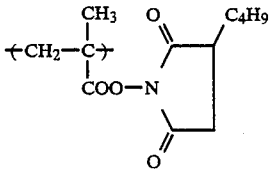 | 34,000 |
| 15 | (A-15) | 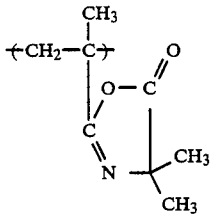 | 29,000 |
| 16 | (A-16) | 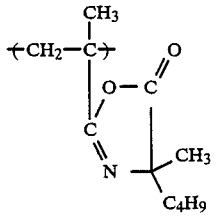 | 35,000 |
| 17 | (A-17) | 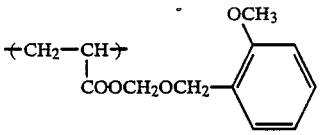 | 44,000 |

Each of the resulting printing plate precursors was processed by means of ELP 404V in the same manner as in Example 1. The resulting master plate for offset printing had a clear reproduced image having a density of 1.2 or more. After etching treatment, the master plate was used for printing. The prints after obtaining 10,000 prints had a clear image free from fog on the non-image areas.

Further, when the precursor was allowed to stand at 45° C. and 75% RH for 24 hours, and then processed in the same manner as described above, the results of printing were quite equal to those obtained above.

EXAMPLE 18

An electrophotographic lithographic printing plate precursor was prepared in the same manner as in Example 1 using a mixture having the same composition as used in Example 1, except that (A-1) was replaced with 30 g of a copolymer (A-18) having the following formula (Mw=42,000) and hexamethylene diisocyanate was used in an amount of 4 g.

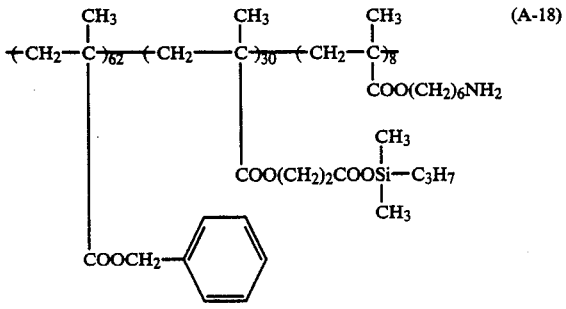

(A-18)

The printing plate precursor was processed in the same manner as in Example 1. The resulting master plate for offset printing reproduced a clear image having a density of 1.0 or more. After etching, printing was carried out by using the resulting printing plate. As a result, more than 10,000 prints having a clear image free from fog were obtained.

Further, when the printing plate precursor was allowed to stand at 45° C. and 75% RH and then processed in the same manner as above, the results of printing were substantially equal to those obtained above.

EXAMPLES 19 to 23

An electrophotographic lithographic printing plate precursor was produced in the same manner as in Example 1, except for replacing hexamethylene diisocyanate as used in Example 1 with each of the cross-linking agents shown in Table 3 below.

TABLE 3

| Example No. | Crosslinking Agent |
|---|---|
| 19 | ethylene glycol diglycidyl ether |
| 20 | Epoint 012 (tradename, produced by Nitto Kasei K.K.) |
| 21 | Rika Resin PO-24 (tradename, produced by New Japan Chemical Co., Ltd.) |
| 22 | diphenylmethane diisocyanate |
| 23 | triphenylmethane triisocyanate |

Each of the resulting printing plate precursors was processed in the same manner as in Example 1 and then etched. The master plate for offset printing as obtained by processing had a clear reproduced image having a density of 1.0 or more. When printing was carried out using the resulting printing plate, more than 10,000 prints having a clear image free from background fog were obtained.

EXAMPLE 24

A mixed solution consisting of 54 g of n-propyl methacrylate, 45g of the monomer compound (i) as used in Example 1, 1.0g of acrylic acid, and 400g of toluene was heated to 70° C. under a nitrogen stream, and 1.5g of 2.2'-azobis(2,4-dimethylvaleronitrile) (V-65) was added thereto, followed by allowing to react for 8 hours. The resulting copolymer was designated as (A-24). The copolymer (A-24) had an Mw of 43,000.

A mixture of 15g (as solid content) of (A-24), 25g of a butyl methacrylate/allyl methacrylate copolymer (B-1) (80/20; Mw=36,000), 200g of zinc oxide, 0.03g of Rose Bengale, 0.01g of Tetrabromophenol Blue, 0.01g of maleic anhydride, and 300g of toluene was dispersed in a ball mill for 2 hours. To the dispersion were added 10g of allyl methacrylate and 0.5g of AIBN, and the mixture was further dispersed in a ball mill for 10 minutes to prepare a photosensitive coating composition. The composition was coated on paper having been rendered conductive to a dry coverage of 20 g/m$^2$ with a wire bar, followed by drying at 100° C. for 1 hour. The photosensitive layer was then allowed to stand in a dark place at 20° C. and 65% RH for 24 hours to produce an electrophotographic lithographic printing plate precursor.

COMPARATIVE EXAMPLE 4

A mixed solution consisting of 54g of n-propyl methacrylate, 45g of the monomer compound (i), 1.0g of acrylic acid, and 400g of toluene was heated to 70° C. in a nitrogen stream, and 1.5g of V-65 was added thereto. The mixture was allowed to react for 8 hours to obtain a copolymer (A-24') (Mw=40,000).

A mixture consisting of 40g of the resulting copolymer (solids content), 200g of zinc oxide, 0.03g of Rose Bengale, 0.01g of Tetrabromophenol Blue, 0.01g of maleic anhydride, and 300g of toluene was dispersed in a ball mill for 2 hours to prepare a photosensitive coating composition. The composition was coated on a conductive paper support to a dry coverage of 20 g/m$^2$ with a wire bar and dried at 100° C. for 1 minute. The photosensitive layer was then allowed to stand in a dark place at 20° C. and 65% RH for 24 hours to prepare an electrophotographic printing plate precursor.

COMPARATIVE EXAMPLE 5

An electrophotographic printing plate precursor was produced in the same manner as in Comparative Example 4, except for using 15g of (A-24) and 25g of a butyl methacrylate/n-propyl methacrylate copolymer (80/20; Mw=40,000) in place of (A-24').

COMPARATIVE EXAMPLE 6

An electrophotographic printing plate precursor was produced in the same manner as in Comparative Example 4, except for using 40g of a butyl methacrylate/n-propyl methacrylate/acrylic acid copolymer (80/19/1; Mw=38,000) in place of (A-24').

Each of the printing plate precursors obtained in Example 24 and in Comparative Examples 4 to 6 was evaluated in the same manner as in Example 1. The results obtained are shown in Table 4 below.

TABLE 4

| | Example 24 | Compar. Example 4 | Compar. Example 5 | Compar. Example 6 |
|---|---|---|---|---|
| Smoothness of Photoconductive Layer (sec/cc) | 93 | 88 | 90 | 75 |
| Electrostatic Characteristics: | | | | |
| V0 (−V) | 560 | 540 | 540 | 530 |
| El/10 (lux. sec) | 8.8 | 8.5 | 8.5 | 9.5 |
| Contact Angle with Water (degree) | 10 | 9 | 12 | 25 to 35 (widely scattered) |
| Quality of Reproduced Image: | | | | |
| Condition I | good | good | good | good |
| Condition II | good | good | good | fair (background fog occurred) |
| Background Stain: | | | | |

TABLE 4-continued

| | Example 24 | Compar. Example 4 | Compar. Example 5 | Compar. Example 6 |
|---|---|---|---|---|
| Condition I | good | good | good | poor |
| Condition II | more than 10,000 prints free from stains | stains observed from the 5,000th print | stains observed from the 7,500th prints | stains observed from the start of printing |

From the results of Table 4, the following considerations can be derived.

The printing plate obtained by using any of the photosensitive material containing the resin (A) and the resin (B) according to the present invention and the photosensitive materials of Comparative Examples 4 and 5 had a clear reproduced image, but the sample of Comparative Example 6 had a deteriorated smoothness of the photoconductive layer. When each sample was processed under Condition II, the sample of Comparative Example 6 had a considerably deteriorated reproduced image as suffering from background fog and had a image density of 0.6 or less.

All the samples except the sample of Comparative Example 6 had a contact angle with water as small as 15° or less, indicating that the surface of the photoconductive layer was rendered sufficiently hydrophilic.

When each of the printing plates was used as a master plate for offset printing, the printing plates of Example 24 and Comparative Examples 4 and 5 proved excellent in resistance to background stains. When each of these printing plates was used for printing under a higher printing pressure, the printing plate of Example 24 produced more than 10,000 prints having satisfactory image quality without suffering from background stains, whereas the printing plate obtained in Comparative Examples 4 and 5 caused background stains from the 5,000th print and 7,500th print, respectively.

When the sample of Example 24 was allowed to stand at 45° C. and 75% RH for 2 weeks and then evaluated for electrophotographic characteristics and printing performance properties in the same manner as in Example 1, no appreciable changes of results were observed.

EXAMPLES 25 TO 36

An electrophotographic lithographic printing plate precursor was produced in the same manner as in example 24, except for replacing (A-24) with 12g of each of the copolymers shown in Table 5 and replacing (B-1) with 28g of a benzyl methacrylate/vinyl methacrylate copolymer (75/25) (B-2).

TABLE 5

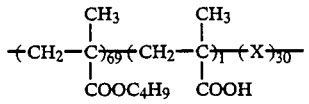

| Example No. | Resin (A) | X in Formula Above | Mw |
|---|---|---|---|
| 25 | A-25 | 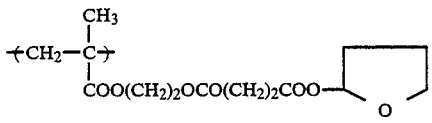 | 35,000 |
| 26 | A-26 | 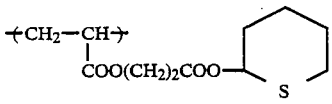 | 38,000 |
| 27 | A-27 | 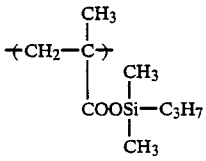 | 34,000 |
| 28 | A-28 | 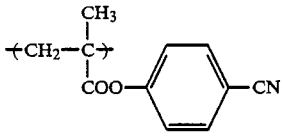 | 33,000 |
| 29 | A-29 | 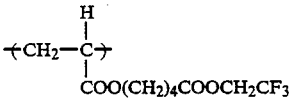 | 36,000 |

TABLE 5-continued

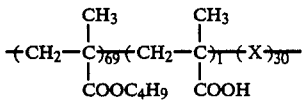

| Example No. | Resin (A) | X in Formula Above | Mw |
|---|---|---|---|
| 30 | A-30 | 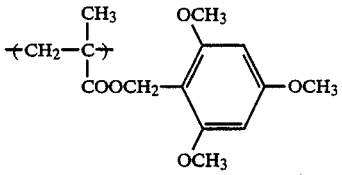 | 41,000 |
| 31 | A-31 | 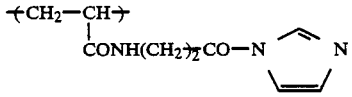 | 36,000 |
| 32 | A-32 | 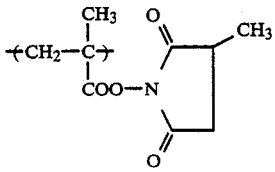 | 31,000 |
| 33 | A-33 | 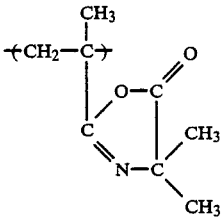 | 32,000 |
| 34 | A-34 | 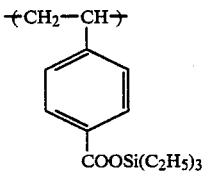 | 29,000 |
| 35 | A-35 | 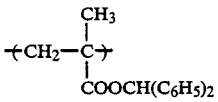 | 30,000 |
| 36 | A-36 | 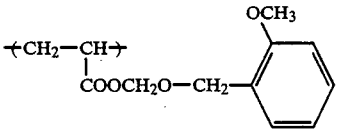 | 36,000 |

Each of the printing plate precursor was processed by means of the same processor as used in Example 1. The resulting master plate for offset printing had a clear image having a density of 1.0 or more. After etching treatment, printing was carried out using the resulting printing plate. As a result, more than 10,000 clear prints free from fog were obtained.

Further, the printing plate precursor was allowed to stand at 45° C. and 75% RH for 2 weeks and then processed in the same manner as above. The results of printing were entirely equal to those obtained above.

EXAMPLE 37 TO 39

A mixture having the same composition as in Example 24, except for replacing (A-24) with 20 g of a copolymer having the following formula (A-37) (Mw=16,000) and replacing (B-1) with 22 g of each of the copolymers shown in Table 6 below, was dispersed in a ball mill for 2 hours to prepare a photosensitive coating composition.

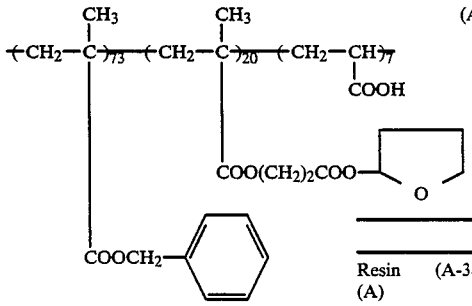

(A-37)

ing printing plate. There were obtained more than 10,000 prints having a clear image free from fog.

EXAMPLE 40

An electrophotographic printing plate precursor was produced in the same manner as in Example 37, except for using 22 g of (A-38) shown below and 18 g of (B-6) shown below as the resin (A) and (B), respectively.

| | | Composition of Resin | Mw |
|---|---|---|---|
| Resin (A) | (A-38) | 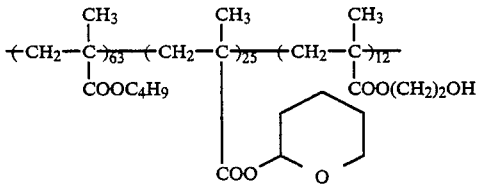 | 21,000 |
| Resin (B) | (B-6) | 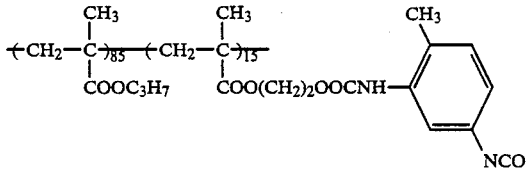 | 38.000 |

The precursor was processed by means of the same processor as used in Example 1. The resulting master plate for offset printing had a density of 1.0 or more, and the reproduced image was clear. After etching, printing was carried out using the plate. As a result, more than 10,000 prints having clear image quality free from fog

TABLE 6

| Example No. | Resin (B) | Structure of Resin (B) | Mw |
|---|---|---|---|
| 37 | B-3 | 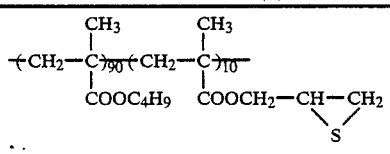 | 40,000 |
| 38 | B-4 | 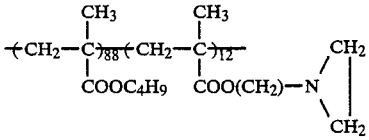 | 35,000 |
| 39 | B-5 | 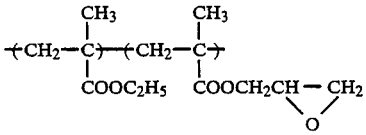 | 34,000 |

The resulting coating composition was coated on paper having been rendered electrically conductive with a wire bar coater to a dry coverage of 25 g/m$^2$ and dried at 105° C. for 1 hour. The thus formed photoconductive layer was allowed to stand in a dark place at 20° C. and 65% RH for 24 hours to obtain an electrophotographic lithographic printing plate precursor.

Each of the resulting printing plate precursors was processed by means of the same processor as used in Example 18. The resulting master plate for offset printing had a clear image having a density of 1.0 or more. After etching, printing was carried out using the resulting printing plate. There were obtained more than 10,000 prints having a clear image free from fog.

EXAMPLE 40

An electrophotographic printing plate precursor was produced in the same manner as in Example 37, except for using 22 g of (A-38) shown below and 18 g of (B-6) shown below as the resin (A) and (B), respectively.

| | | Composition of Resin | Mw |
|---|---|---|---|
| Resin (A) | (A-38) |  | 21,000 |
| Resin (B) | (B-6) |  | 38.000 |

The precursor was processed by means of the same processor as used in Example 1. The resulting master plate for offset printing had a density of 1.0 or more, and the reproduced image was clear. After etching, printing was carried out using the plate. As a result, more than 10,000 prints having clear image quality free from fog were obtained.

When the precursor was processed after being allowed to stand at 45° C. and 75% RH for 2 weeks and printing was carried out in the same manner, the results obtained were quite the same as those obtained above.

EXAMPLE 41

An electrophotographic printing plate precursor was produced in the same manner as in Example 37, except for using 15 g of (A-27) and 25 g of (B-7) (Mw=33,000) shown below as the resins (A) and (B), respectively.

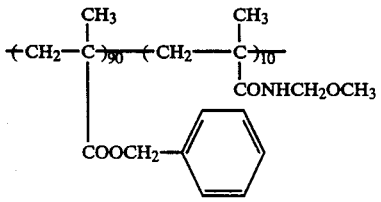

(B-7)

A master plate for offset printing obtained by processing the printing plate precursor by means of the same processor as used in Example 1 had a clear reproduced image having a density of 1.0 or more. After etching, printing was carried out. As a result, more than 10,000 prints having a clear image free from fog were obtained.

When the precursor was processed after being allowed to stand at 45° C. and 75% RH for 2 weeks and printing was carried out in the same manner as above, the results obtained were quite the same as those obtained before standing.

As described above, the present invention provides an electrophotographic lithographic printing plate precursor from which a printing plate excellent in resistance to background stains and printing durability can be obtained.

While the invention has been described in detail and with reference to specific embodiments thereof, it will be apparent to one skilled in the art that various changes and modifications can be made therein without departing from the spirit and scope thereof.

What is claimed is:

1. An electrophotographic lithographic printing plate precursor comprising a conductive support having provided thereon at least one photoconductive layer containing photoconductive zinc oxide and a resin binder, wherein said resin binder comprises (A) at least one resin containing at least one functional group capable of forming at least one carboxyl group upon decomposition upon treatment with an oil-desensitizing solution or dampening water and at least one of (B) a heat-curable or a photo-curable resin, and (C) a cross-linking agent.

2. An electrophotographic lithographic printing plate precursor as in claim 1, wherein said resin (A) is a resin containing at least one functional group represented by formula (I)

$$-COO-L_1 \qquad (I)$$

wherein $L_1$ represents

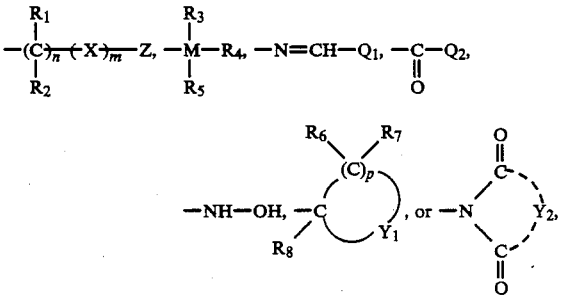

wherein $R_1$ and $R_2$ each represents a hydrogen atom or an aliphatic hydrocarbon group, X represents an aromatic hydrocarbon group; Z represents a hydrogen atom, a halogen atom, a trihalomethyl group, an alkyl group, —CN, $-NO_2$, $-SO_2R_1'$, wherein $R_1'$ represents a hydrocarbon group, $-COOR_2'$, wherein $R_2'$ represents a hydrocarbon group, or $-O-R_3'$, wherein $R_3'$ represents a hydrocarbon group; n and m each represents 0, 1, or 2; $R_3$, $R_4$, and $R_5$ each represents a hydrocarbon group or $-O-R_4'$, wherein $R_4'$ represents a hydrocarbon group; M represents Si, Sn, or Ti; $Q_1$ and $Q_2$ each represents a hydrocarbon group; $Y_1$ represents an oxygen atom or a sulfur atom; $R_6$, $R_7$, and $R_8$ each represents a hydrogen atom or an aliphatic hydrocarbon group; p represents 3 or 4; and $Y_2$ represents an organic residual group forming a cyclic imido group.

3. An electrophotographic lithographic printing plate precursor as in claim 1, wherein said resin (A) is a resin containing at least one functional group represented by formula (IV)

$$-CO-L_2 \qquad (IV)$$

wherein $L_2$ represents

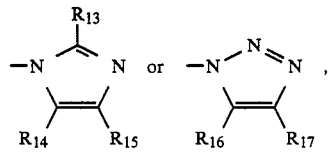

wherein $R_{13}$, $R_{14}$, $R_{15}$, $R_{16}$, and $R_{17}$ each represents a hydrogen atom or an aliphatic group.

4. An electrophotographic lithographic printing plate precursor as in claim 1, wherein said resin (A) is a resin containing at least an oxazolone ring represented by formula (V)

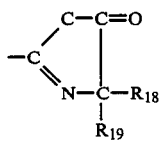

(V)

wherein $R_{18}$ and $R_{19}$ each represents a hydrogen atom or a hydrocarbon group, or $R_{18}$ and $R_{19}$ together form a ring.

5. An electrophotographic lithographic printing plate precursor as in claim 1, wherein said resin (A) comprises a copolymer component represented by formula (VI)

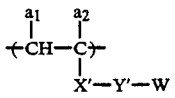

(VI)

wherein X' represents —O—, —CO—, —COO—, —OCO—,

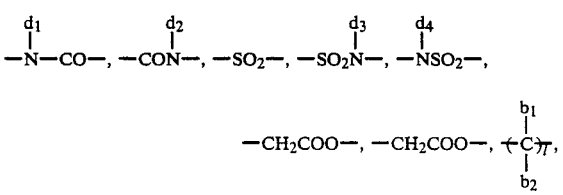

an aromatic group, or a heterocyclic group, wherein $d_1$, $d_2$, $d_3$, and $d_4$ each represents a hydrogen atom, a hydrocarbon group, or the group (Y'—W) in formula (VI); $b_1$ and $b_2$ each represents a hydrogen atom, a hydrocarbon group, or the group (Y'—W) in formula (VI); and l represents 0 or an integer of from 1 to 18; Y' represents a carbon-carbon bond for linking X' and W, and Y' may contain a hetero atom; W represents a functional group represented by formula (I):

$$-COO-L_1 \quad (I)$$

wherein $L_1$ represents

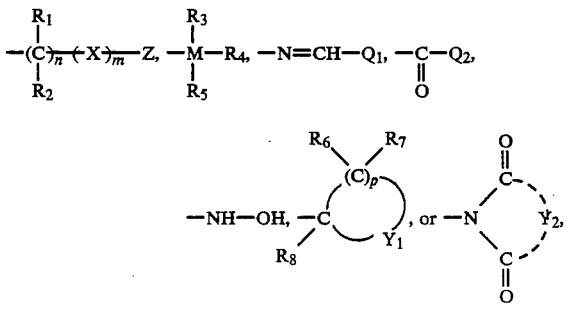

wherein $R_1$ and $R_2$ each represents a hydrogen atom or an aliphatic hydrocarbon group, X represents an aromatic hydrocarbon group; Z represents a hydrogen atom, a halogen atom, a trihalomethyl group, an alkyl group, —CN, $-NO_2$, $-SO_2R_1'$, wherein $R_1'$ represents a hydrocarbon group, $-COOR_2'$, wherein $R_2'$ represents a hydrocarbon group, or —O— $R_3'$, wherein $R_3'$ represents a hydrocarbon group; n and m each represents 0, 1, or 2; $R_3$, $R_4$, and $R_5$ each represents a hydrocarbon group or $-O-R_4'$, wherein $R_4'$ represents a hydrocarbon group; M represents Si, Sn, or Ti; $Q_1$ and $Q_2$ each represents a hydrocarbon group; $Y_1$ represents an oxygen atom or a sulfur atom; $R_6$, $R_7$, and $R_8$ each represents a hydrogen atom or an aliphatic hydrocarbon group; p represents 3 or 4; and $Y_2$ represents an organic residual group forming a cyclic imido group, a functional group represented by formula (II)

$$-CO-L_2 \quad (II)$$

wherein $L_2$ represents

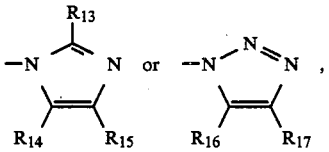

wherein $R_{13}$, $R_{14}$, $R_{15}$, $R_{16}$, and $R_{17}$ each represents a hydrogen atom or an aliphatic group, or a functional group represented by formula (V)

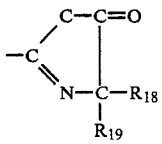

(V)

wherein $R_{18}$ and $R_{19}$ represents a hydrogen atom or a hydrocarbon group, or $R_{18}$ and $R_{19}$ are taken together to form a ring;

and $a_1$ and $a_2$ each represents a hydrogen atom, a halogen atom, a cyano group, a hydrocarbon group; or —X'—Y'— represents a chemical bond directly linking

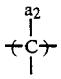

and —W.

6. An electrophotographic lithographic printing plate precursor as in claim 5, wherein said resin (A) contains the copolymer component represented by formula (VI) in a proportion of from 0.1 to 95% by weight.

7. An electrophotographic lithographic printing plate precursor as in claim 1, wherein said resin (A) contains a copolymer component cross-linkable with at least one of the resin (B) and the cross-linking agent (C).

8. An electrophotographic lithographic printing plate precursor as in claim 1, wherein said resin (B) is a resin cross-linkable with the functional group of the resin (A).

9. An electrophotographic lithographic printing plate precursor comprising a conductive support having provided thereon at least one photoconductive layer containing photoconductive zinc oxide and a resin binder, wherein said resin binder comprises A) at least one resin containing at least one functional group capable of forming at least one carboxyl group upon decomposition upon treatment with an oil-desensitizing solution or dampening water and at least one of (B) a heat-curable or a photo-curable resin, and (C) a cross-linking agent wherein said resin (A) is a resins containing at least one functional group represented by formula (I), formula (IV) or formula (V):

$$-COO-L_1 \quad (I)$$

wherein $L_i$ represents

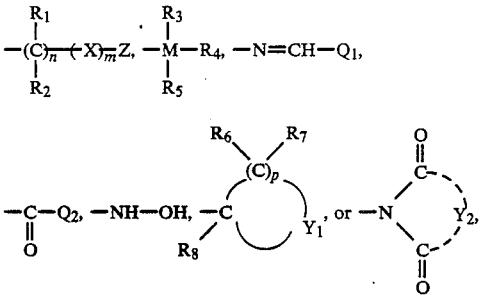

wherein $R_1$ and $R_2$ each represents a hydrogen atom or an aliphatic hydrocarbon group, X represents an aromatic hydrocarbon group; Z represents a hydrogen atom, a halogen atom, a trihalomethyl group, an alkyl group, —CN, $-NO_2$, $-SO_2R_1$ represents a hydrocarbon group, $-COOR_2$, wherein $R_2$ represents a hydrocarbon group, or —O—$R_3$, wherein $R_3$ represents a hydrocarbon group; n and m each represents 0.1 or 2; $R_3$, $R_4$ and $R_5$ each represents a hydrocarbon group or —O—$R_4$, wherein $R_4$ represents a hydrocarbon group; M represents Si, Sn or Ti; $Q_1$ and $Q_2$ each represents a hydrocarbon group; $Y_1$ represents an oxygen atom or a sulfur atom; $R_6$, $R_7$ and $R_8$ each represents a hydrogen atom or an aliphatic hydrocarbon group; p represents 3 or 4; and $Y_2$ represents an organic residual group forming a cyclic imido group;

$$-CO-L_2 \quad \text{(IV)}$$

wherein $L_2$ represents

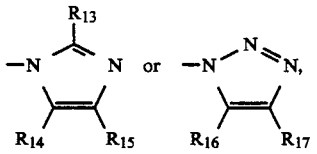

wherein $R_{13}$, $R_{14}$, $R_{15}$, $R_{16}$ and $R_{17}$ each represents a hydrogen atom or an aliphatic group; and

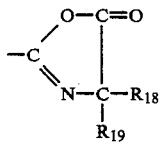

(V)

wherein $R_{18}$ and $R_{19}$ each represents a hydrogen atom or a hydrocarbon group, or $R_{18}$ and $R_{19}$ together form a ring.

10. An electrophotographic lithographic printing plate precursor comprising a conductive support having provided thereon at least one photoconductive layer containing photoconductive zinc oxide and a resin binder, wherein said resin binder comprises (A) at least one resin containing at least one functional group capable of forming at least one carboxyl group upon decomposition upon treatment with an oil-desensitizing solution or dampening water and (B) a heat-curable or a photo-curable resin.

11. An electrophotographic lithographic printing plate precursor comprising a conductive support having provided thereon at least one photoconductive layer containing photoconductive zinc oxide and a resin binder, wherein said resin binder comprises (A) at least one resin containing at least one functional group capable of forming at least one carboxyl group upon decomposition upon treatment with an oil-desensitizing solution or dampening water and (C) a cross-linking agent.

12. An electrophotographic lithographic printing plate precursor as ian claim 12, wherein the weight ratio of the resin (A) to resin (B) is from 5/95 to 80/20.

13. An electrophotographic lithographic printing plate precursor as in claim 11, wherein said cross-linking agent is present in an amount of from 0.1 to 30% by weight based on the weight of resin binder.

* * * * *